United States Patent [19]

Harshbarger et al.

[11] Patent Number: 4,534,192

[45] Date of Patent: Aug. 13, 1985

[54] SECURITY DOOR

[75] Inventors: Harry F. Harshbarger, Robertsdale; John L. Kurz, McConnellsburg; Patrick J. Young, Defiance, all of Pa.

[73] Assignee: JGR Enterprises, Inc., Fort Littleton, Pa.

[21] Appl. No.: 459,236

[22] Filed: Jan. 19, 1983

[51] Int. Cl.[3] ..... E05B 63/14

[52] U.S. Cl. ..... 70/118; 70/DIG. 42; 109/59 R; 292/335; 292/337

[58] Field of Search ..... 70/114, 116, 118–120, 70/DIG. 42; 292/34, 36, 335, 337, DIG. 62, 35, 37; 109/59

[56] References Cited

U.S. PATENT DOCUMENTS

| | | | |
|---|---|---|---|
| Re. 29,712 | 8/1978 | Shipman | 70/120 |
| 609,197 | 8/1898 | Fries | 292/36 |
| 1,190,439 | 7/1916 | Marchfeld | 70/120 X |
| 1,495,820 | 5/1924 | Tierney | 70/118 X |
| 1,568,353 | 1/1926 | Tullis | 292/335 |
| 1,662,450 | 3/1928 | Anderson | 292/335 |
| 1,863,461 | 6/1932 | Bailey | 292/335 |
| 1,892,446 | 12/1932 | Carr | 70/DIG. 42 X |
| 2,973,984 | 3/1961 | Burke | 292/37 X |
| 4,037,440 | 7/1977 | Shabtai et al. | 70/120 X |
| 4,100,774 | 7/1978 | Solovieff et al. | 70/DIG. 42 X |
| 4,263,795 | 4/1981 | Van Gompel | 292/337 X |

FOREIGN PATENT DOCUMENTS

| | | | |
|---|---|---|---|
| 137187 | 4/1934 | Fed. Rep. of Germany | 70/118 |
| 811246 | 1/1937 | France | 292/36 |
| 223119 | 10/1924 | United Kingdom | 70/120 |

*Primary Examiner*—Gary L. Smith
*Assistant Examiner*—Russell W. Illich
*Attorney, Agent, or Firm*—Brady, O'Boyle & Gates

[57] ABSTRACT

A door is locked in the closed position by a system of five bolts which can be simultaneously operated from either side of the door by a handle or key operator. Both the handle and key operator are common to all of the bolts in the system and are connected through a rotary camming device with a linkage including parts drivingly connected with the bolts. A lost motion connection is provided between the key operator and rotary camming device to enable complete rotation and withdrawal of the key. The linkage and bolts are protectively enclosed inside of tough conduits and linkage access housings. A safety bolt immobilizing device is provided on the door adjacent to one bolt of the locking system to block the extension of the bolts while the door is open and this device moves automatically to a bolt release position when the door is closed. The locking system can be placed in a residential door or may be installed on a commercial door.

14 Claims, 14 Drawing Figures

FIG. 1
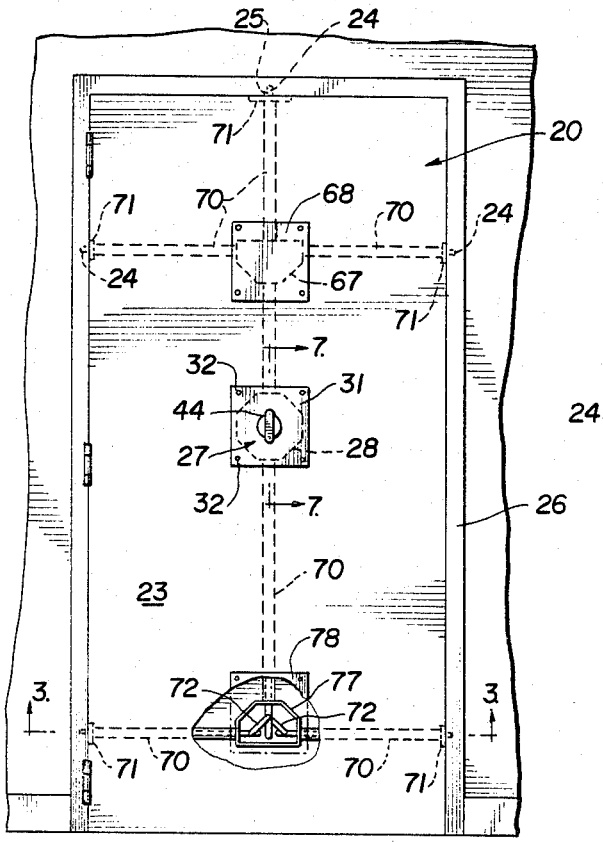
FIG. 2
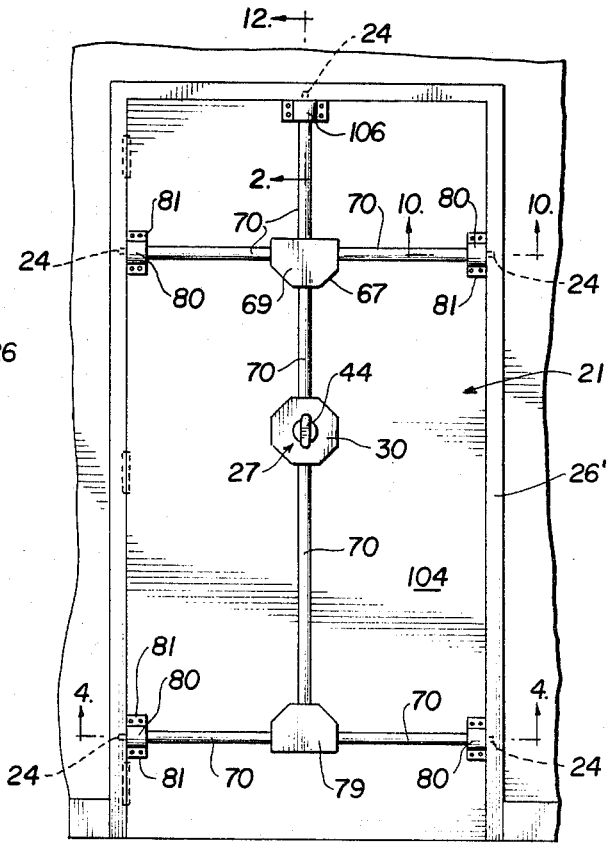
FIG. 3
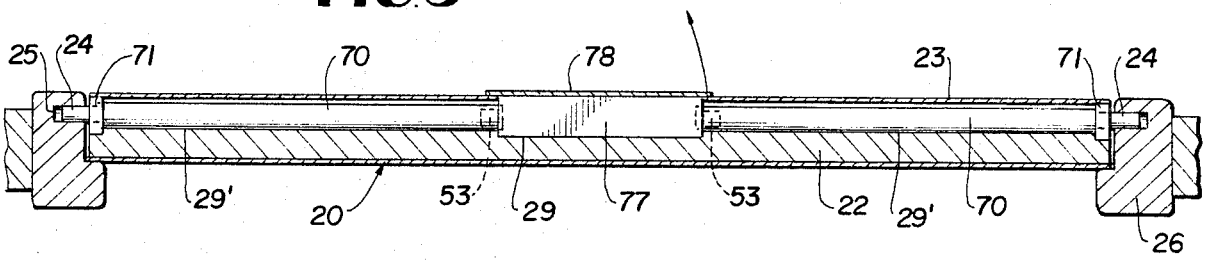
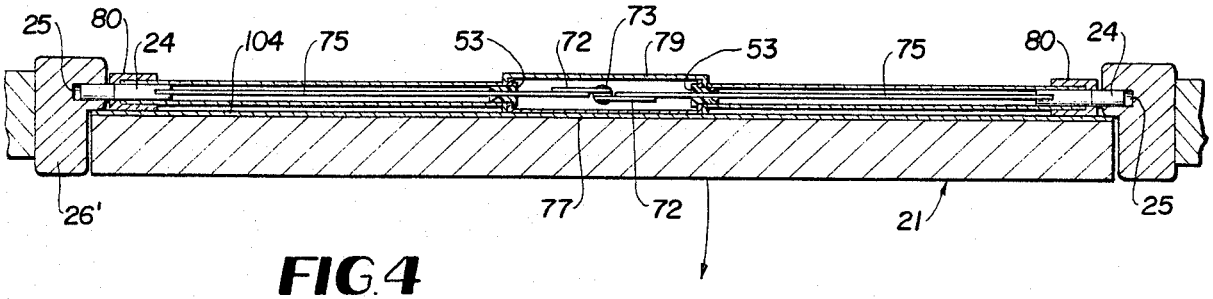
FIG. 4

FIG.12
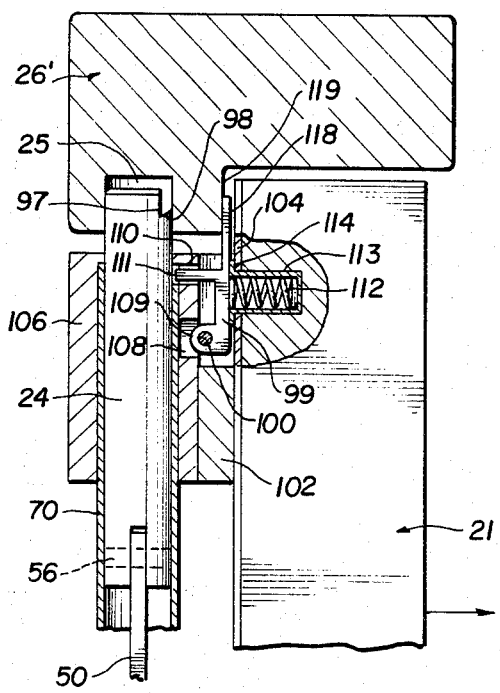
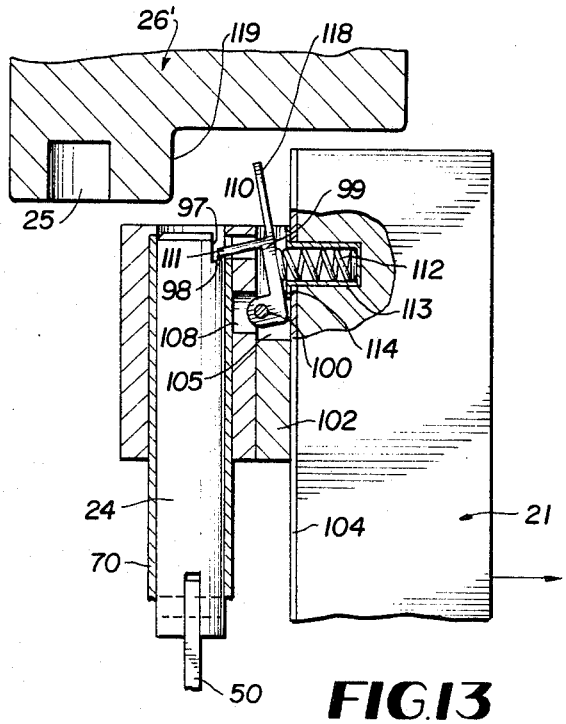
FIG.13
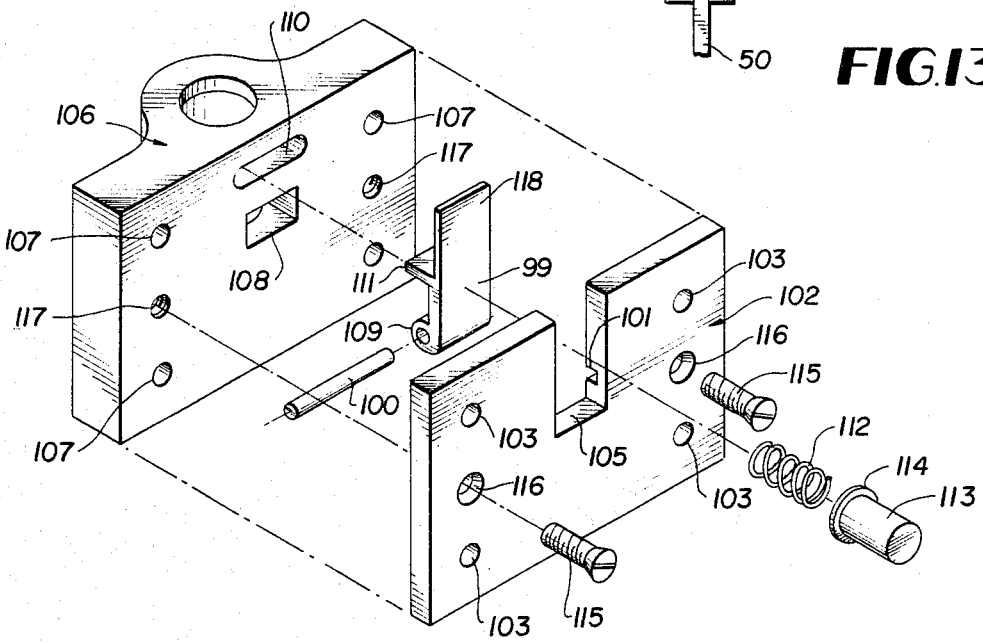
FIG.14

SECURITY DOOR

This invention relates to security doors of the residential and commercial types having multiple locking bolts which can be operated simultaneously by a handle and key actuated mechanism common to the bolts and drivingly connected therewith through a linkage.

An important object of the invention is to provide a multiple bolt mechanism for doors of the above-mentioned type in which the bolts and their operating linkage components are fully enclosed to provide maximum resistance to damage.

Another object is to provide in a security door of the mentioned types an automatic safety device for immobilizing the bolts in retracted non-locking positions when the door is opened, so that damage caused by slamming a door with its bolts extended cannot occur.

Still another object of the invention is to provide a multiple bolt locking system for residential and commercial doors which is practical in construction, compact, durable, convenient and easy to operate from either side of a door, and which requires relatively little maintenance.

Another object and feature of the invention resides in providing a simplified and relatively inexpensive bolt operating mechanism common to all of the bolts and drivingly connected with the bolts by an enclosed linkage having dry lube guide bushings and a unique rotational lost motion arrangement whereby a conventional outside key operator may be employed along with an inside handle requiring a lesser degree of rotation to operate the bolts.

Other features and advantages of the invention will become apparent to those skilled in the art during the course of the following description.

BRIEF DESCRIPTION OF THE DRAWINGS

FIG. 1 is an interior side elevation of an inwardly opening security door and door bolting system according to the invention.

FIG. 2 is an interior side elevation of an outwardly opening security door and door bolting system according to a second embodiment of the invention.

FIG. 3 is an enlarged horizontal cross section taken on line 3—3 of FIG. 1.

FIG. 4 is a similar view taken on line 4—4 of FIG. 2.

FIG. 12 is an enlarged fragmentary vertical section taken on line 12—12 of FIG. 2.

FIG. 13 is a view similar to FIG. 12 showing the security door opening while its locking bolts are immobilized in retracted positions.

FIG. 14 is an exploded perspective view of a bolt immobilizing device and its mounting means adjacent to one bolt guide.

DETAILED DESCRIPTION

Figure 5:
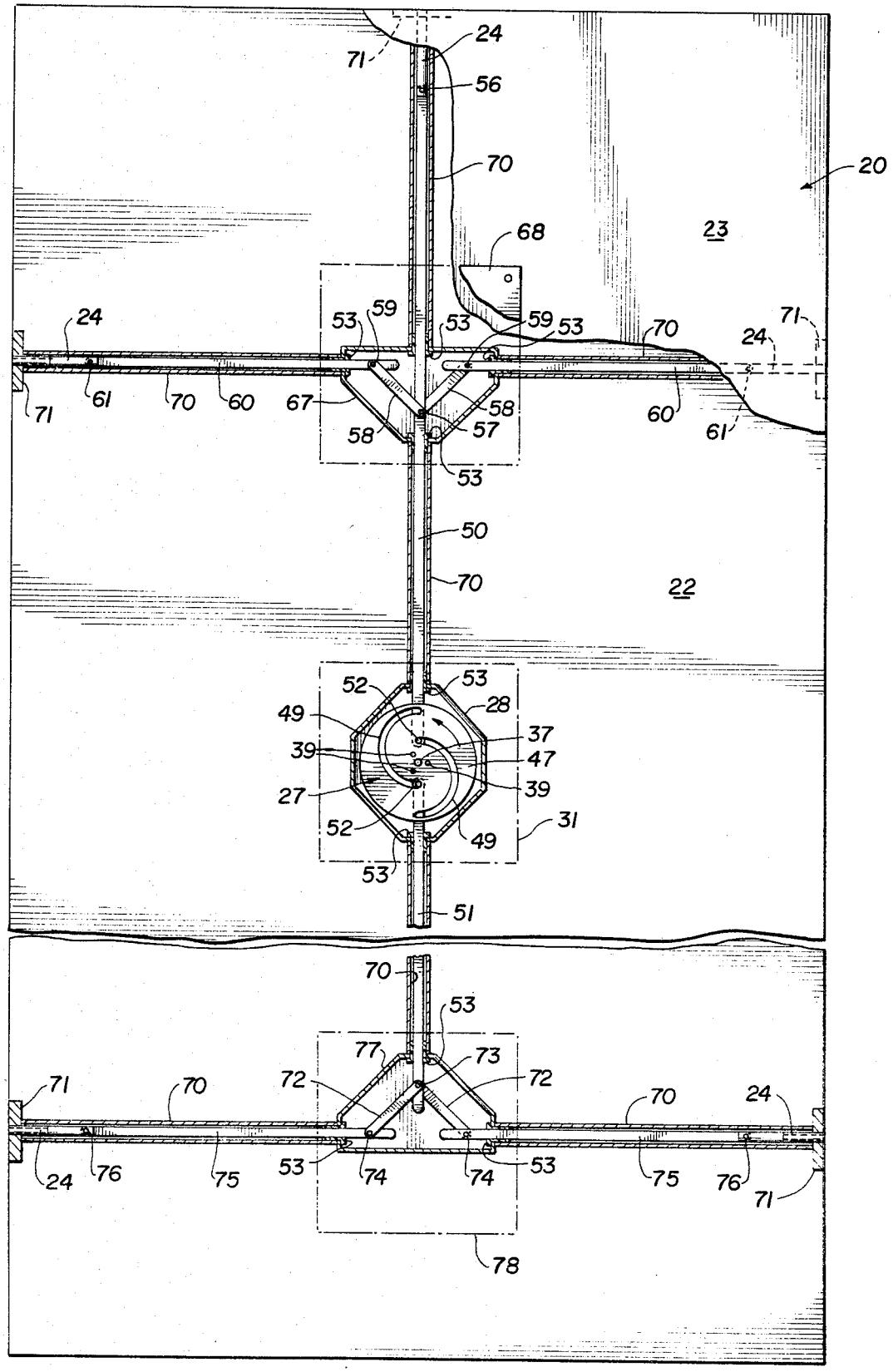
FIG. 5 is an enlarged interior side elevation of the door shown in FIG. 1 with the interior skin of the door partly removed and with the door bolts retracted, parts in section.

Referring to the drawings in detail wherein like numerals designate like parts throughout, FIGS. 1, 3 and 5 depict a flush inwardly opening door 20, such as a main access door for a home. FIGS. 2 and 4 illustrate a commercial door 21 which opens outwardly. FIGS. 6 through 11 of the drawings show mechanism substantially common to both types of doors 20 and 21, and FIGS. 12 to 14 show a bolt disabling device which has been illustrated in connection with the commercial door 21 but is applicable to either form of door embodying the present invention.

Figures 6, 9:
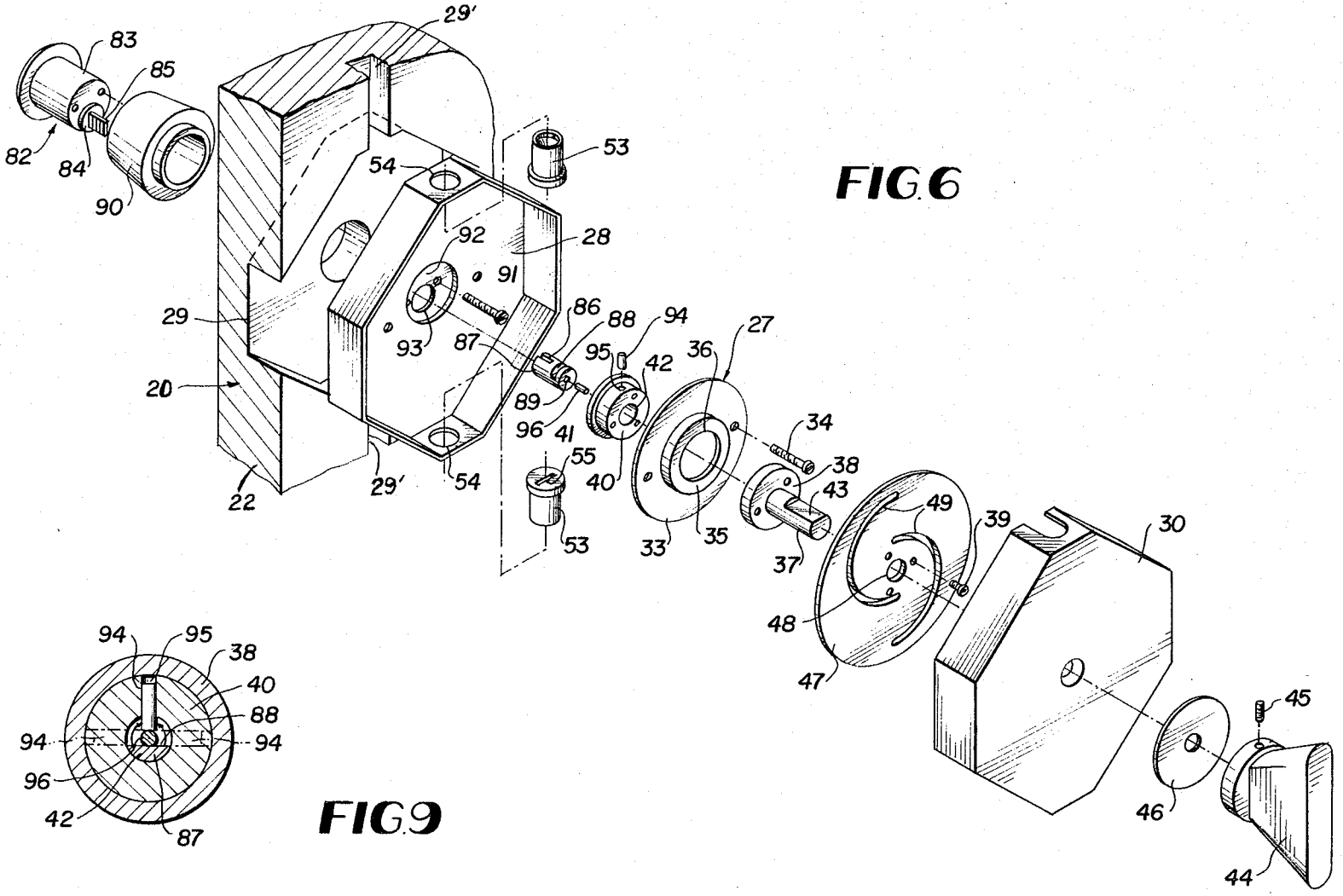
FIG. 6 is an exploded perspective view of manual and key operating means for the door bolting system.
FIG. 9 is an enlarged vertical section taken on line 9—9 of FIG. 7 showing a lost motion connection for a key operator.

The flush door 20 includes a body portion 22 and an interior skin 23. The security bolting system forming the main subject matter of the invention is housed and concealed in recesses 29 and grooves 29' in the body portion 22 and beneath skin 23, as shown in FIGS. 3 and 6. In the case of the commercial door 21, the bolting system or mechanism is exposed on the interior side of the door where appearance is not a main consideration.

With reference to both forms of doors 20 and 21, the security bolting system comprises five locking bolts 24 including two pairs of horizontal axis side bolts and one vertical axis top bolt. The five bolts of the system are operated in unison by an interior handle or an exterior key operator, as will be fully described. When in their extended locking positions, FIGS. 1–4, the bolts 24 are received in keeper openings 25 formed in door frames 26 and 26' for the inwardly and outwardly opening residential and commercial doors 20 and 21.

For both types of doors 20 and 21, the security bolting system including the five bolts 24 further comprises an operating assembly 27 common to the five bolts and arranged centrally on the door. The assembly 27 comprises a preferably octagonal support housing 28 which is received in a recess 29 in the interior side of the residential door 20. In the case of the commercial door 21, the housing 28 is attached to the interior face of the door. The housing is equipped with a cooperative cover 30 which telescopes over it on the commercial door 21. Instead of the cover 30 on the residential door, the housing 28 is closed at the interior side of the door by a flat access plate 31 of brass or the like secured by screws 32 to the adjacent door skin 23.

The operating assembly 27 further comprises a support plate 33 anchored by screws 34 to the floor of housing 28. The support plate 33 includes a crowned portion 35 having an opening 36 which serves as a cantilever support for a spindle 37 having a forward cup extension 38 which is cylindrical. Fixed within the cup extension 38 by screws 39 is a collar 40 having a forward flange 41 and a central bore 42. The spindle 37 and collar 40 thus form a rotational unit in the operating assembly 27. The fixed crowned portion 35 of plate 33 in addition to acting as a cantilever support for elements 37 and 40 forms a rotational bearing for the elements whose parts 38 and 41 slidably engage opposite faces of the crowned portion 35, FIG. 7.

The spindle 37 has a flat 43 at its interior end projecting beyond the interior face of the door 20 or 21 and a turning handle 44 for the spindle 37 is locked thereto by a set screw 45 which engages the flat 43. A thin dry lube washer 46 is preferably placed between the handle or knob 44 and the adjacent cover plate 31 or housing cover 30 in the case of a commercial door 21.

A relatively large diameter rotary disc 47 having a central opening 48 and a pair of eccentrically spaced opposing arcuate slots 49 is engaged over the spindle 37 and held by the screws 39 tightly against the back face of cup extension 38. Long vertical links 50 and 51 are connected by shoulder screws 52 with the rotary disc 47, the shoulder screws 52 riding in the arcuate slots 49 which act as cams to move the two links 50 and 51 longitudinally in opposite directions along their vertical axes which coincide. The links 50 and 51 are guided in their movements by dry lube bushings 53 held in openings 54 in the top and bottom walls of the octagonal housing 28. The bushings 53 have restricted slots 55 which match the flat cross sectional shapes of the links 50 and 51 to guide the latter with precision and without binding on their linear paths of movement.

The upper vertical link 50 leads to and is connected near the top of the door by a pin 56 with the top vertical axis bolt 24. Substantially midway between the operating assembly 27 and the top bolts 24, the link 50 is connected by a pin 57, FIG. 5, to two short divergent links 58 which in turn are pivotally connected by pins 59 to a pair of equal length longer horizontal links 60, connected at their outer ends by pins 61 to the upper pair of horizontal bolts 24.

Figure 10:
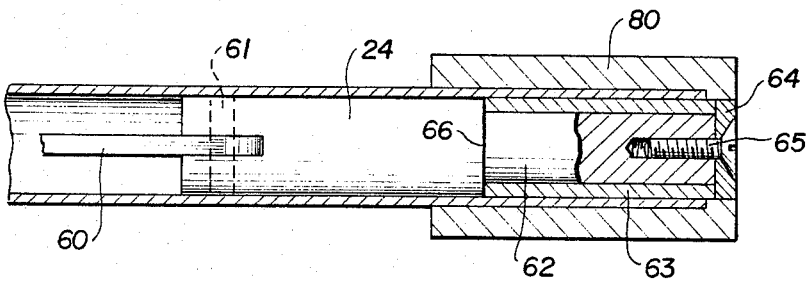
FIG. 10 is an enlarged fragmentary section taken on line 10—10 of FIG. 2.

Preferably, each of the five bolts 24 is constructed in the manner shown in FIG. 10. Each bolt includes a reduced diameter outer end portion 62 on which a stainless steel or hardened steel sleeve 63 is placed and held by a retainer plate 64 and screw 65 at the outer end of the bolt against a shoulder 66. The hardened steel sleeve 63 resists damage to the bolts when they are extended.

The short links 58 and the interior ends of horizontal links 60 and the adjacent part of vertical link 50 are enclosed in a housing 67 in both forms of doors 20 and 21. For the residential door 20, the housing 67 is covered by a rectangular access plate 68 on the interior face of the door identical to the plate 31. For the commercial door 21, the housing 67 has a slip cover 69 similar to the cover 30. Additional slotted dry lube bushings 53 for the smooth guidance of the links 50 and 60 are mounted on the walls of housing 67, FIG. 5. Tough tubing sections 70, such as electrical conduit sections, enclose and protect the links 50 and 60 between the housings 28 and 67 and between the housing 67 and bolt guides for the top and upper pair of side bolts 24. As shown in FIG. 5, the inner ends of protective conduits 70 are friction telescoped over the dry lube bushings 53 protruding from housing 67, the enlarged heads of the bushings 53 retaining them in the housing and thus functioning to connect the conduits 70 to the housing. The outer ends of the conduits 70 are aligned with apertures in mortice plates 71 of the top and upper pair of side bolts 24. The bolts themselves are constructed in the manner described previously relative to FIG. 10, and the apertures of the mortice plates 71 are somewhat larger than the diameters of sleeves 63. The conduits 70 which guide the bolts are recessed in grooves 29′ in the body portion 22 of door 20, FIGS. 5, 6, and 8, and are covered by skin 23 in the residential door.

Near the bottom of the door, another pair of short divergent links 72 are connected by a pin 73 to the lower end of vertical link 51, and the lower ends of links 72 are connected by pins 74 with two lower horizontal laterally movable links 75 connected by pins 76 near their outer ends with the lower pair of side horizontal bolts 24 which protrude through mortice plates 71 for the residential door 20. A housing 77 encloses the links 72 and adjacent parts and this housing on its side walls carries additional slotted dry lube guide bushings 53 for the smooth guidance of links 51 and 75. In the residential door 20, the housing 77 is covered by another rectangular plate 78 attached by screws to the interior skin 23 of the door. In the case of the commercial door 21, FIG. 2, the housing 77 has a slip cover 79 placed thereover.

The movable links 51 and 75 are additionally enclosed in conduit sections 70 as described previously for the upper links 50 and 60, and the inner ends of the lower conduit sections 70 are telescoped over the dry lube bushings 53 of housing 77. The outer ends of the lower horizontal conduits 70 which function as bolt guides, are aligned with apertures in mortice plates 71.

It can be seen that the entire five bolt door locking system and its operating linkage is housed and protected by the tough electrical conduits 70 or equivalent tubing sections and the associated metal housings 28, 67 and 77 and the mortice plates 71. The complete protection for the system is afforded on both the residential and commercial doors 20 and 21.

Figure 11:
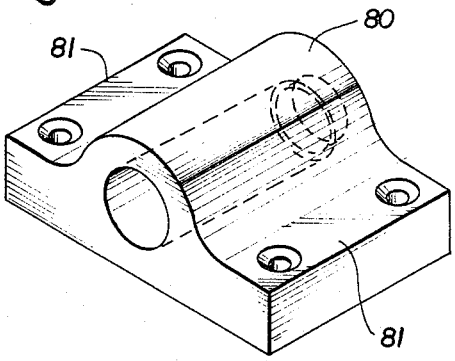
FIG. 11 is a perspective view of a bolt guide.

FIG. 11 shows a bolt guide 80 employed on the commercial door 21 in lieu of the mortice plates 71 of the flush type residential door 20. The outer ends of the conduits 70 are socketed in bores of the bolt guides 80 which have side apertured extensions 81 which facilitate mounting on the inner face of the outwardly opening commercial door 21, FIG. 2.

Returning to the bolt operating assembly 27, this assembly further comprises on the outside of doors 20 and 21 a conventional key-operated unit 82 by means of which a person possessing a proper key can unlock and open the door from its outside. The device 82 includes a cylindrical body 83 containing an eccentrically arranged cylinder 84 which can be rotated by a proper key, the cylinder 84 carrying a projecting tab 85 which is received in a slot 86 formed in the forward end of a cylindrical plug 87. The plug 87 also possesses a cross slot 88 near its other end intersected by a central axial blind bore 89 in such end.

Figure 7:
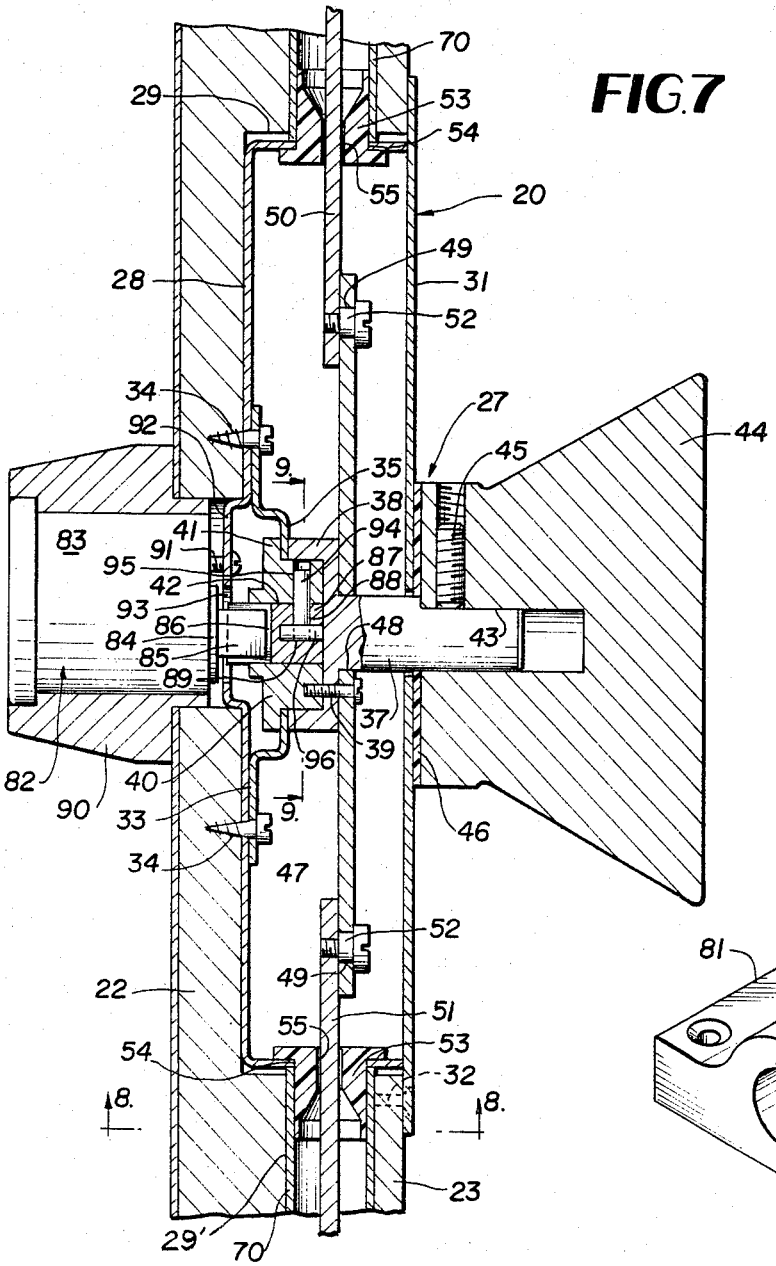
FIG. 7 is an enlarged fragmentary vertical section taken on line 7—7 of FIG. 1 showing the operating means of FIG. 6 assembled.
Figure 8:
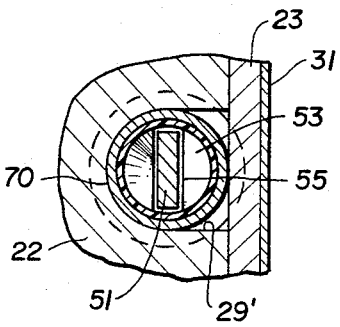
FIG. 8 is an enlarged fragmentary horizontal section taken on line 8—8 of FIG. 7.

The rotary cylinder 84 and tab 85 are coaxial with the spindle 37. The key-operated unit 82 and a surrounding collar 90 are secured in the assembly 27 by screws 91 which connect the unit 82 to a center depressed web 92 of housing 28. This web 92 has an opening 93 which receives the forward end of plug 87 and interfitting tab 85, as shown in FIG. 7.

A unique feature of the operating assembly 27 resides in a 180° lost motion connection between the key-operated cylinder 84 and the handle-operated spindle 37. This connection is required because a 180° rotation of the spindle 37 and camming disc 47 by means of inside handle 44 will move all of the bolts 24 simultaneously from their retracted non-locking positions to their extended locking positions beyond the edges of the door, whereas a full 360° of rotation of the key-operated cylinder 84 is required to operate the bolting mechanism and to achieve removal of the key after reverse rotation of the cylinder 84 through 360°.

The required lost motion connection comprises the utilization of a radial pin 94 held within a radial opening 95 of collar 40 with its inner end portion extending into the cross slot 88 of plug 87 movably, and the inner end of the pin 94 riding slidably on the periphery of an axial cylindrical pin 96 which is pressed into the bore 89 of plug 87, FIG. 9. When a proper key is used to turn the lock cylinder 84 and projecting tab 85, the cylinder and tab can rotate a full 180° with the plug 87 before any rotation will be imparted to the spindle 37 to operate the bolts 24. Further rotation of the cylinder 84 and tab 85 by the key, after the initial 180° of lost motion, will serve to rotate the spindle 37 another 180° required to fully retract the bolts 24 by the action of the disc 47 on the bolt linkage. As shown in FIG. 9, when the key rotates the cylinder 84 and plug 87 during the lost motion cycle, the radial pin 94 anchored in the collar 40 will move in the cross slot 88 of plug 87 and during this movement the inner end of the pin 94 will engage and follow the periphery of the axial pin 96 to create the required lost motion. In FIG. 9, the pin 94 can move 90° in either direction from the vertical position shown in full lines before contacting the bottom of cross slots 88 in plug 87. After such contact by the pin 94, the collar 40 will begin to rotate with the plug 87 and pin 94, and spindle 37 being attached to the collar 40 will also rotate under influence of the key the required additional distance to operate the bolts 24. During the lost motion cycle, the plug 87 and its slot 88 actually do the turning under influence of the key and the pin 94 and collar 40 are stationary until the bottom face of the slot 88, FIG. 9, rotates into contact with one side of the pin 94.

A further important feature of the invention shown in FIGS. 12 to 14 is a device for immobilizing the locking bolts 24 in their retracted positions whenever the door is open. In the drawings, the device is shown applied to the top vertical bolt 24 of commercial door 21. However, the device could be utilized equally well on the residential door 20.

In FIGS. 12 to 14, the top bolt 24 is provided in its upper end on one side with a notch 97 whose lower end face 98 is preferably inclined at 30° to the horizontal. A cooperative dog 99 to immobilize the top bolt 24 in its retracted position, FIG. 13, has its lower end pivotally mounted on a horizontal axis pin 100 held in a groove 101 of a flat mounting plate 102 attached by screws, not shown, applied through openings 103 to the interior face of door 21 which has an interior skin 104. The pivoted dog 99 lies within a center slot 105 opening through the top edge of plate 102.

A modified guide 106 for the top bolt 24 has corner apertures 107 to register with the mounting plate apertures 103 and to receive the same mounting screws. Additionally, the bolt guide 106 has a generally central rectangular opening 108 into which the knuckle 109 of pivoted dog 99 can project. Another passage 110 in the bolt guide 106 above the opening 108 receives a forwardly projecting bolt blocking arm 111 carried by the dog 99.

The dog 99 is biased on its pivot to the bolt blocking position shown in FIG. 13 by a compression spring 112 held in a cartridge sleeve 113 placed in a recess formed in the interior face of the door 21. The cartridge sleeve has a forward flange 114 which lies on the exterior face of the door skin 104. A pair of screws 115 received by openings 116 in mounting plate 102 engage threaded openings 117 in bolt guide 106 and serve to clamp the parts 102 and 106 together whereby the pin 100 is held captive in the groove 101.

It may be seen that, whenever the door 21 is separated from the door jamb 26' with the locking bolts 24 retracted by operation of the assembly 27, the spring 112 which bears on the rear of the dog 99 will move the same to the bolt immobilizing position, where the blocking extension 111 enters the notch 97 of the bolt above the inclined face 98. In this situation, it is impossible to extend the bolts 24 by use of the handle 44 or a key and should the door be slammed closed the bolts cannot damage the door frame or the locking mechanism as would occur if the bolts were extended. The immobilizing action of the dog 99 is automatic whenever the door is opened.

Similarly, when the door 21 is returned to the closed position shown in FIG. 12, the top extension 118 of the dog 99 which is inclined and spaced from the door will contact the stop face 119 of the door jamb or frame and as a result of this contact, the dog is automatically returned to a vertical position as shown in FIG. 12 where the blocking arm 111 is withdrawn from the notch 97 of the bolt, the spring 112 being compressed by the pivoted dog as the door is closed. When fully closed, the dog extension 118 which is thin lies between the door and the stop face 119 and the top bolt 24 is free to enter the keeper opening 25 above it with which it is aligned under control of the operating assembly 27. Thus, the safety bolt immobilizing device is completely automatic in its operation and affords full protection against damaging the door frame and door locking mechanism caused by slamming the door while the bolts are extended. The safety device is very simple and highly compact.

Concerning the movement of the bolts 24 in unison between their locking and non-locking positions, it will be understood that a 180° rotation of the slotted camming disc 47 in either direction under influence of the inside handle 44 or an outside key will impart the required simultaneous linear movements to the two vertical links 51, which in turn act on the links 58 and 72 to extend or retract the horizontal links 60 and 75 horizontally with the associated bolts. The operation of the assembly 27 is smooth and requires little effort. The provision of the guide bushings 53 constitute a major reason for the ease of operation of the bolt operating linkage by the assembly 27. The advantages of the invention should be readily apparent to those skilled in the art.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. In a security door having a plurality of locking bolts adapted to be extended beyond edges of the door into keeper openings of a door frame and to be retracted to non-locking positions, a drive linkage for the bolt on the door operable to extend and retract all of the bolts in unison, and an operating assembly for the drive linkage, said assembly comprising a support plate fixed to the door and having an annular portion, a rotational spindle assembly bodily supported on the annular portion for rotation around the annular portion, a camming element secured to the spindle assembly to turn therewith and having connections with parts of said linkage to operate the same during rotation of the camming element to operate said bolts, a rotational handle fixed to the spindle assembly adjacent to one side of the door and operable to rotate the spindle assembly in opposite directions sufficiently to move said bolts to and from their extended locking and retracted positions, a key operator fixed on the other side of the door and having a turnable cylinder and projecting tab substantially coaxial with the spindle assembly, a rotational element journaled on the spindle assembly coaxially and being drivingly coupled to said tab, and means forming a rotational lost motion connection between said rotational element coupled with the tab and said spindle assembly including a cross-slot in said rotational element, and a radial drive element carried by the spindle assembly extending into the cross-slot, whereby the cylinder and tab when turned by a key through 360° in either direction can cause lost motion rotation of said rotational element for 180° prior to imparting 180° rotation to the spindle assembly and camming element to operate said bolts.

2. In a security door as defined in claim 1, wherein said plurality of locking bolts comprises five bolts including a top vertical axis bolt and an upper and lower pair of horizontal axis bolts, and said drive linkage including two coaxial vertical axis links extending above and below said operating assembly and having corresponding ends connected with said camming element.

3. In a security door as defined in claim 1, and a tough penetration-resistant enclosure means for said linkage.

4. In a security door as defined in claim 1, wherein said camming element is a disc having a pair of opposing arcuate slots whose centers are spaced eccentrically in opposite diametrical directions from the center of the disc, the center of the disc being coaxial with the rotational spindle assembly, and said linkage including a pair of coaxial longitudinally shiftable links extending perpendicular to the rotational axis of the disc and spindle assembly, and elements engaging movably within said arcuate slots and being connected with the links of said pair.

5. In a security door as defined in claim 4, and said plurality of locking bolts comprising five bolts including a top vertical axis bolt and upper and lower pairs of coaxial horizontal bolts, one link of said pair being connected to and directly driving said top vertical axis bolt and said one link between its ends being further drivingly connected with a pair of horizontal axis drive links for the upper pair of horizontal bolts, and the second link of the pair of links connected to said disc being drivingly connected with another pair of horizontal axis drive links for the lower pair of horizontal bolts, whereby all of the bolts can be operated in unison.

6. In a security door as defined in claim 5, and the connections between the first and second links of said pair connected with said disc with the pairs of drive links for the upper and lower horizontal bolts being through pairs of relatively short divergent connector links whose opposite ends are pivotally connected between the links of said pair and said horizontal drive links.

7. In a security door as defined in claim 6, and protective enclosure means for said drive linkage and bolts including tube sections surrounding the vertical axis and horizontal axis links of the linkage, and protective housings surrounding said disc and said pairs of divergent connector links and being secured to said tube sections.

8. In a security door as defined in claim 7, and dry lube guide bushings for said links also serving as the connections of the tube sections with said housings through telescoping engagement with the tube sections.

9. In a security door as defined in claim 10, and said links comprising comparatively thin rectangular cross section links, and said dry lube bushings having matching cross section guide slots for said links.

10. In a security door as defined in claim 9, and said protective enclosure means further comprising bolt guides on the door adjacent to each bolt and said tubing sections being socketed in the bolt guides.

11. In a security door as defined in claim 9, and each bolt comprising a cylindrical body portion slidably engaged in one of said tube sections and having a reduced diameter forward extension, and a hardened damage-resistant sleeve fixed on said extension.

12. In a security door having a plurality of locking bolts adapted to be extended beyond edges of the door into keeper openings of a door frame and to be retracted to non-locking positions, a drive linkage for the bolts on the door operable to extend and retract all of the bolts in unison, and an operating assembly for the drive linkage, said assembly comprising a support plate fixed to the door and having an annular portion, a rotational spindle assembly bodily supported on the annular portion for rotation around the annular portion, a camming element secured to the spindle assembly to turn therewith and having connections with parts of said linkage to operate the same during rotation of the camming element to operate said bolts, a rotational handle fixed to the spindle assembly adjacent to one side of the door and operable to rotate the spindle assembly in opposite directions sufficiently to move said bolts to and from their extended locking and retracted positions, a key operator fixed on the other side of the door and having a turnable cylinder and projecting tab substantially coaxial with the spindle assembly, a rotational element journaled on the spindle assembly coaxially and being drivingly coupled to said tab, and means forming a rotational lost motion connection between said rotational element coupled with the tab and said spindle assembly, whereby the cylinder and tab when turned by a key in either direction can cause lost motion rotation of said rotational element for predetermined distances prior to imparting rotation to the spindle assembly, said means forming a rotational lost motion connection comprising a cross slot in said rotational element, an axial cylindrical element disposed in a bore of the rotational element and intersecting the cross slot, a radial drive element in the rotational spindle assembly and extending within the cross slot and contacting the periphery of the axial cylindrical element, whereby rotation of the rotational element in either direction will cause engagement of the floor of the cross slot with one side of the radial drive element to rotate the spindle assembly in one direction following a lost motion interval.

13. In a security door as defined in claim 12, and the floor of said cross slot being straight and being substantially diametrical in said rotational element to provide a total lost motion travel of the rotational element of substantially 180°.

14. In a security door having plural simultaneously operable locking bolts movable between extended locking positions and retracted non-locking positions, a device for immoblizing said bolts in their retracted non-locking positions comprising a bolt guide for one of said bolts fixed to the door near one edge thereof and having opening means, a pivoted dog disposed movably in the opening means of the bolt guide and having a bolt blocking arm on one side thereof extending perpendicular to said dog and adapted to project from the opening means into a bore of the bolt guide containing said bolt and across the path of movement of a surface of said bolt to block movement of the bolt toward its extended locking position, resilient means engaging the pivoted dog and urging it with said blocking arm toward a position of blocking engagement with said bolt surface, and an extension on the pivoted dog adapted to engage an opposing door frame surface when the door carrying said device is closed to thereby move the dog on its pivot against the force of said resilient means to a position where said blocking extension is withdrawn from blocking engagement with the bolt surface and lies wholly within the opening means of the bolt guide, said bolt comprising a surface on one side of the bolt disposed at an inclined angle to the longitudinal axis of the bolt, and said bolt guide comprising a flat mounting plate detachably connected to the interior face of said door and having a passage opening through one edge thereof and an opposing bolt guide body detachably connected to the flat mounting plate and having a pair of passages in communication with said passage of the mounting plate, a pivot pin for the pivotal support of said dog disposed in a groove of the mounting plate and held captive in said groove by contact of the opposing faces of the mounting plate and said bolt guide body, and the resilient means comprising a compression spring disposed in a cavity of the door communicating with the passage of the mounting plate and exerting pressure on the rear of the pivoted dog biasing it to the bolt immobilizing position.

* * * * *